US007429719B1

(12) United States Patent
Spetz

(10) Patent No.: US 7,429,719 B1
(45) Date of Patent: Sep. 30, 2008

(54) SELF-REGULATING HEATER WITH A SEMICONDUCTOR HEATING ELEMENT AND METHOD OF HEATING

(75) Inventor: William L Spetz, Cincinnati, OH (US)

(73) Assignee: Stellar Systems, Inc., Cincinnati, OH (US)

( * ) Notice: Subject to any disclaimer, the term of this patent is extended or adjusted under 35 U.S.C. 154(b) by 0 days.

(21) Appl. No.: 11/464,013

(22) Filed: Aug. 11, 2006

Related U.S. Application Data

(60) Provisional application No. 60/708,288, filed on Aug. 15, 2005.

(51) Int. Cl.
*H05B 1/02* (2006.01)

(52) U.S. Cl. ..... 219/482; 219/501; 219/505; 323/907

(58) Field of Classification Search ..... 219/481–486, 219/497, 492, 499, 501, 504, 505, 507, 506, 219/494; 338/22 R, 225 C; 307/221 R, 117; 323/229, 349, 907
See application file for complete search history.

(56) References Cited

U.S. PATENT DOCUMENTS 3,987,311 A * 10/1976 Thornburg ..... 377/78
4,050,427 A * 9/1977 Hollins ..... 261/39.3
4,134,447 A * 1/1979 Frosch et al. ..... 165/263

* cited by examiner

*Primary Examiner*—Mark Paschall
(74) *Attorney, Agent, or Firm*—Wood, Herron & Evans, LLP

(57) ABSTRACT

A self-regulating heater including a semiconductor for converting electrical energy to heat. A temperature sensitive element is used to bias the semiconductor as a function of temperature. The heating element has an advantage that its maximum temperature is limited by the biasing network, yet full power is available just below the limit.

18 Claims, 4 Drawing Sheets

SELF-REGULATING HEATER WITH A SEMICONDUCTOR HEATING ELEMENT AND METHOD OF HEATING

This application claims the benefit of U.S. Provisional Patent Application Ser. No. 60/708,288, filed on Aug. 15, 2005, the entirety of which is incorporated by reference herein.

FIELD OF THE INVENTION

The invention relates to heaters and more particularly, provides a self-regulating heater using a semiconductor as a heating element.

BACKGROUND OF THE INVENTION

Conversion from electrical energy into heat is traditionally achieved with a resistive heater element in series with a control element. When electrical current passes through the resistive heater element, heat is produced in proportion to the resistance and to the square of the current. In a known linear control system, a control element adjusts current flow through the resistive heater element to produce a desired amount of heat. The control system often operates in response to a signal from a temperature sensor that is placed in the vicinity of a heat load. A disadvantage of this linear approach is that a significant amount of heat is dissipated in a device controlling the current flow through the resistive heater element; and thus, efficiency of the system is low.

In another known system, a controller drives an output switching device such that, it is either fully on or off. This approaches an ideal switch with zero dissipation. Proportional control is obtained by controlling the relative on and off times of the switching device, that is, its duty cycle, rather than the current amplitude. If the duty cycle, that is, a complete on-off cycle, is made considerably faster, for example, at least an order of magnitude faster, than a thermal time constant of the system, this system performs as well as the linear system described above without the power dissipation or loss in the controller. As in the above linear system, the controller often senses temperature and adjusts the duty cycle and hence, the power dissipated by the resistor, so that the load achieves the desired temperature.

Both of the above systems are capable of producing very good static temperature control performance, and considerable prior art exists for achieving this performance. However, there are at least two inherent disadvantages to these systems. A first disadvantage relates to dynamic capability. In order to provide a fast thermal response, the resistive heater element must be sized so that it can produce considerably more heat than is needed to maintain the load at a desired temperature. This implies that, at 100 percent duty cycle operation, that is, fully on, the resistive heater element must be capable of raising the temperature of the load considerably above a desired temperature set point. Often, it is not economically feasible to provide a control system that regulates the voltage across the heater element; and therefore, the maximum power that is dissipated under a 100 percent duty cycle may vary considerably under variable voltage conditions. This is because the power that is dissipated in a fixed value resistor varies with the square of the applied voltage. Thus, a fifty percent increase in voltage more than doubles the power that must be dissipated. Depending upon the nature of the load, this often produces excessive temperatures, either for the resistive heater element or the load. The effect is that the thermal gain of such a system is proportional to the square of the voltage across the heating element.

A second disadvantage relates to operation of the heater under failure conditions. Most heaters fail to an open circuit, a short circuit, or a lowered resistance condition. An open circuit condition usually poses no concern because current flow through the heating element ceases, and the heater operation just stops. A short circuit condition in a heater that is properly protected by a high current fuse or circuit breaker is not a problem if the current to the heater element is interrupted promptly. The difficulty occurs when the heater partially shorts, producing a lower resistance than expected. A heater resistance value may occur that produces a current that is too low to trip the protective device, yet is high enough to produce excessive power. If the controller cannot act fast enough or if it has failed, then excessive temperatures may result.

Another failure mode of concern is where a system control failure causes the switching stage to remain on at a 100 percent duty cycle, which provides maximum current flow in the heater for an extended period. In this situation, the overcapacity of the heater may be enough to develop excessive temperatures without tripping a protective device.

SUMMARY OF THE INVENTION

The invention provides a self-regulating heater using a semiconductor as a heating element that has a fast response and is temperature limited. Further, the heater of the present invention avoids the problems that often plague resistive heaters and therefore, is particularly useful in simpler, lower cost heater applications.

According to the principles of the present invention and in accordance with the described embodiments, the invention provides a self-regulating heater connectable to a power supply. The heater includes a semiconductor for converting electrical energy into thermal energy. A biasing network has a device with a negative temperature coefficient that is thermally coupled to the semiconductor. The biasing network operates the semiconductor to cause the semiconductor to conduct more current at lower temperatures and less current at higher temperatures. Thus, the semiconductor initially rapidly increases in temperature; and upon reaching a given temperature, the device with the negative temperature coefficient operates to reduce current in the semiconductor to provide a maximum semiconductor temperature.

In one aspect of this invention, the biasing network uses a nonlinear element that is operable to cause current conduction in the semiconductor to remain substantially constant until the given temperature is reached. In another aspect of this invention, a switch and switching control are operable to control current conduction through the semiconductor to maintain the semiconductor at a temperature set point less than the given temperature. In a still further aspect of this invention, the nonlinear element is a zener diode; the semiconductor is a field effect transistor; and the device is a thermistor.

In another embodiment of the invention, a method of operating a self-regulating heater first initiates current conduction through a semiconductor to convert electrical energy to thermal energy and raise the temperature of the semiconductor to a given temperature. The semiconductor is thermally coupled to a device with a negative temperature coefficient, which controls current conduction through the semiconductor to maintain the semiconductor temperature about at the given temperature.

These and other objects and advantages of the present invention will become more readily apparent during the following detailed description taken in conjunction with the drawings herein.

BRIEF DESCRIPTION OF THE DRAWINGS

The accompanying drawings, which are incorporated herein and constitute a part of this specification, illustrate embodiments of the invention and, together with a general description of the invention given above, and the detailed description of the embodiments given below, serve to explain the principles of the invention.

DETAILED DESCRIPTION

Figure 1:
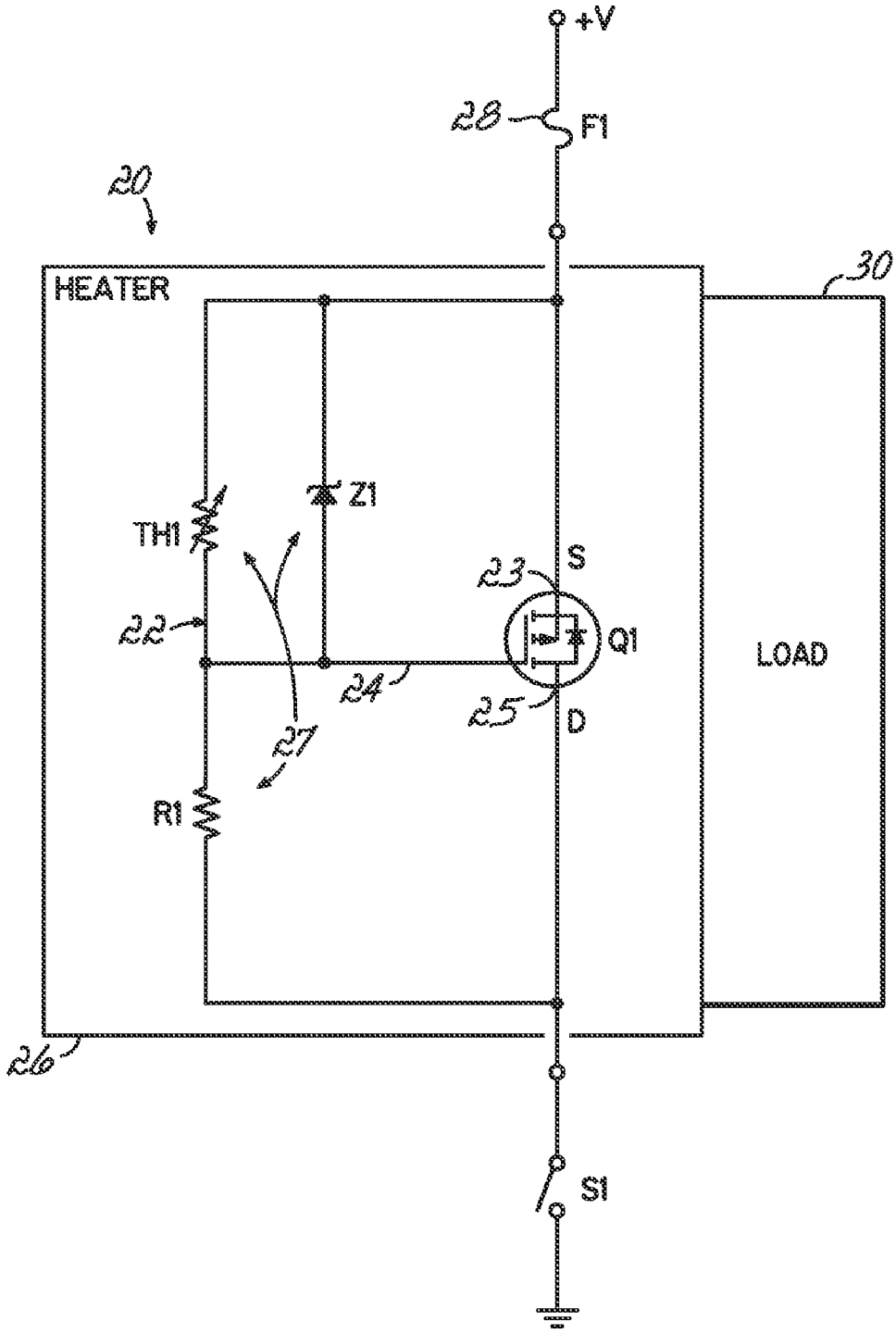
FIG. 1 is a schematic circuit diagram of one exemplary embodiment of a self-regulating heater using a semiconductor in accordance with the principles of the present invention.

Referring to FIG. 1, in one exemplary embodiment, a self-regulating heater 20 is implemented by a heater circuit 22 using a semiconductor Q1, for example, a P channel field-effect transistor ("FET"), as a heating element. The FET Q1 has a gate 24 that functions as a control input. A positive DC supply +V is connected to a source lead 23. A simple grounded switch S1 is connected to a drain lead 25, and the switch S1 may be used as a control element for the heater circuit 22. In alternative embodiments, semiconductor Q1 can be implemented using either an N channel FET or a PNP or NPN bipolar device with similar results. In this exemplary embodiment, a biasing network 27 includes a device having a negative temperature coefficient, for example, a thermistor TH1, a nonlinear element, for example, a zener diode Z1, and a bias resistor R1. The thermistor TH1 and zener diode Z1 are connected in a parallel circuit that is connected between the positive DC supply +V and FET gate 24. The bias resistor R1 is connected between the FET gate 24 and the switch S1. Further, the thermistor TH1 is tightly thermally coupled with a case 26 of the FET Q1; and in this exemplary embodiment, thermistor TH1, bias resistor R1 and zener diode Z1 are all enclosed by the case 26. The heater 20 is designed so that a thermal load 30 can be thermally coupled to, that is, brought into a heat transfer relationship with, the FET Q1 via the case 26.

In operation, almost all of the heat is dissipated by the FET Q1; and the thermistor TH1 and bias resistor R1 dissipate very little heat. At lower temperatures, with switch S1 closed, the thermistor TH1 has a relatively high impedance; and hence, a higher voltage relative to the voltage across bias resistor R1. In this lower temperature state, the zener diode Z1 biases gate 24 of FET Q1 at a constant voltage with respect to the source 23; and therefore, the FET Q1 operates as a constant current load across the power supply +V. The bias resistor R1 simply provides a return current path for the biasing network.

Upon closing the switch S1 at a lower temperature, the zener diode Z1 maintains a constant bias on the gate 24; and the FET Q1 is turned On to provide a relatively high current flow therethrough. The FET Q1 converts electrical energy into thermal energy generally in direct proportion to the current flow magnitude. The temperature of the case 26 rises relatively rapidly as shown at 40 in FIG. 2; and the case 26 transfers heat into the load 30. However, as the temperature of the case 26 rises, the resistance of the thermistor TH1 goes down. Hence, the voltage across TH1 goes down; and the voltage across R1 goes up. Eventually the impedance of TH1 drops low enough to reduce the voltage across TH1 to less than the breakdown voltage of the zener Z1. Continued lessening of the impedance of TH1 reduces the voltage at the gate 24 of the FET Q1, which, in turn, reduces the current through the FET Q1 and thus, the heat being generated by the FET Q1. The heat being transferred into the load 30 is likewise reduced. As the lessening impedance of thermistor TH1 reduces current through the FET Q1, the rate of temperature rise of the FET Q1 is reduced as shown at 42 in FIG. 2. The thermistor TH1 continues to reduce current conduction through the FET Q1 to provide a relatively stable self-limiting temperature as shown at 44 in FIG. 2.

In summary, the zener diode Z1 initially maintains the FET Q1 in a substantially constant current mode. The temperature of the FET Q1 increases rapidly to a temperature at which the negative temperature coefficient of the thermistor TH1 causes the thermistor TH1 to reduce current flow in the FET Q1, so that the temperature of the FET Q1 stabilizes at the self-limiting temperature T1. In the absence of the thermistor TH1, the temperature of the FET Q1 would increase to a maximum temperature T2 as shown in phantom at 46 in FIG. 2. Therefore, in this embodiment, the heater 20 operates as a stand-alone temperature controller; and the temperature of the load 30 will generally follow the temperature of FET Q1 depending on the thermal coupling therebetween.

Figure 2:
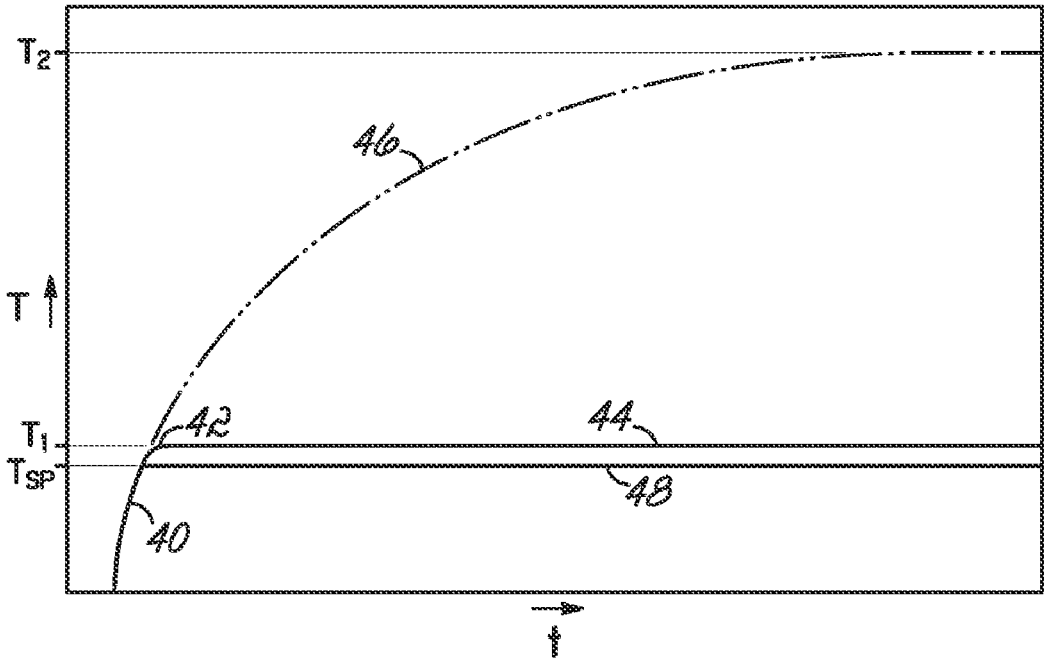
FIG. 2 is a graphical representation of temperatures resulting from an operation of the heater of FIG. 1.
Figure 3:
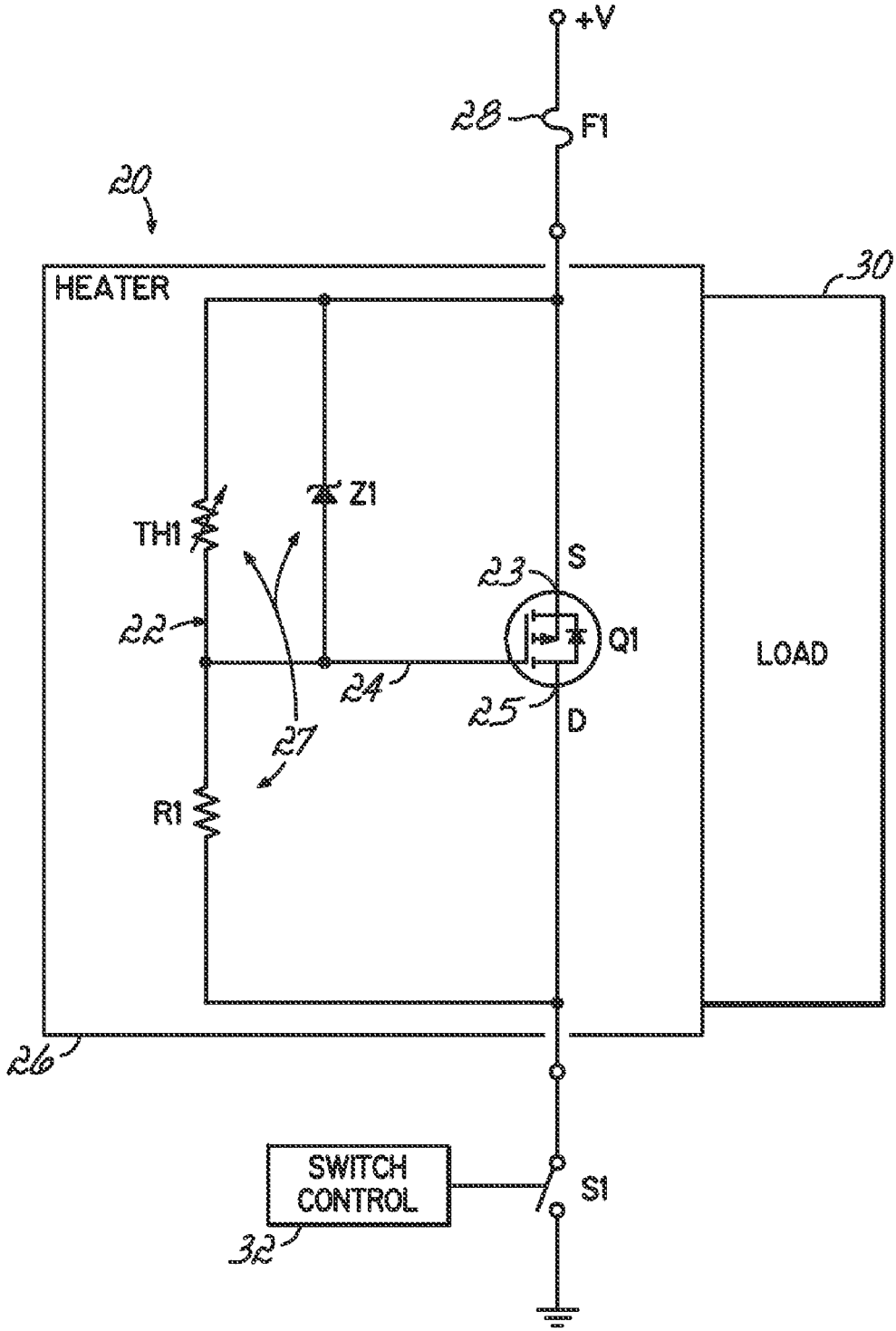
FIG. 3 is a schematic circuit diagram of another exemplary embodiment of a self-regulating heater using a semiconductor in accordance with the principles of the present invention.

In another exemplary embodiment shown in FIG. 3, the heater 20 is operable in a closed loop system. The components in FIG. 3 that have the same labels as the components in FIG. 1 are substantially identical therewith. In this embodiment, the components determining the heater's self-limiting design temperature T1 are chosen to set a temperature higher than a temperature setpoint $T_{SP}$. Further, the switch S is operated by a switch control 32 that provides an automatic temperature control cycle. The switch control 32 closes the switch S1 for an initial period, and the FET Q1 of heater 20 rapidly warms the load 30 as shown at 40 in FIG. 2. As the temperature setpoint is approached, the switch control 32 operates the switch S1 as a function of a control strategy so that the temperature settles around the temperature setpoint as shown at 48 in FIG. 2. In this embodiment, the switch control 32 may be a programmable device that implements a proportional, integral, derivative ("PID") control strategy using a pulse width modulator to vary the duty cycle of the switch S1 in a known manner.

Figure 4:
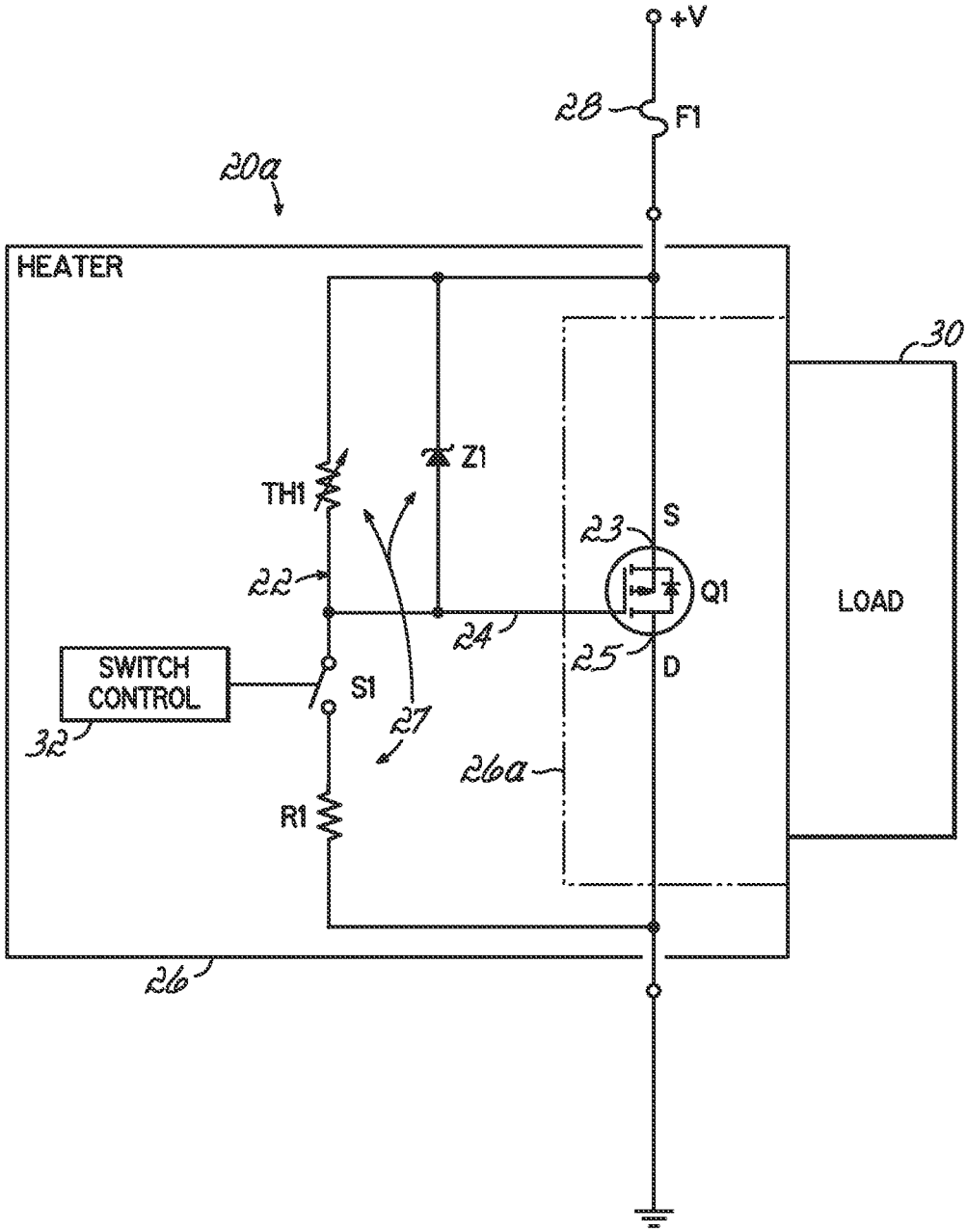
FIG. 4 is a schematic circuit diagram of a further exemplary embodiment of a self-regulating heater using a semiconductor in accordance with the principles of the present invention.

A further exemplary embodiment of a closed loop operation is shown in FIG. 4. The components in FIG. 4 that have the same labels as the components in FIG. 3 are substantially identical therewith. The heater 20*a* in FIG. 4 differs from the heater 20 in FIG. 3 in two respects. First, in this embodiment, the case 26*a*, as shown in phantom, encloses only the FET Q1; and the thermistor TH1; bias resistor R1 and zener diode Z1 are discrete components outside the case 26*a*. In this embodiment, the thermistor TH1 is still tightly thermally coupled with the case 26*a*. Second, in this embodiment, the switch S1 is placed between the bias resistor R1 and the gate 24. Therefore, the switch S1 in FIG. 4 is switching a lower power signal than the switch S1 in FIG. 3. In design, as with FIG. 3, the components determining the heater's self limiting temperature are chosen to set a temperature higher than a temperature setpoint, which provides a high rate of heat transfer to the load 30. The operation of the heater 20*a* of FIG. 4 is similar to that described with respect to the heater 20 of FIG. 3 and as shown in FIG. 2.

In all of the embodiments described herein, since the FET Q1, is operated as a constant current source, its output power is linearly proportional to the applied voltage, instead of its square. This means that the system gain is far less sensitive to large input voltage variations. Thus, it is easier to size a protective device and to stabilize a control algorithm. Further, in most applications, the heater cutoff temperature can be set high enough above the temperature setpoint, so that full power is available up to the setpoint temperature as indicated by the steep slope 50 in FIG. 2.

Failure Mode Operation

There are several failure mechanisms that may occur. The simplest are those that cause no current through the heater element. For example, if a lead breaks or the FET Q1, experiences an open circuit condition; as with the case of conventional heaters, the FET Q1, simply stops conducting and thus, stops heating. Alternatively, if the failure results in a shorted lead or loss of the bias, then a very high current will result and can be expected to trip an external circuit protection device 28, for example, a fuse.

The most difficult failure situation is one that causes a dangerously high temperature, but with current that is not high enough to trip the circuit protection 28. However, the probability of this happening with this implementation is far less than with currently available resistance heating elements.

While the present invention has been illustrated by a description of an embodiment, and while such embodiment has been described in considerable detail, there is no intention to restrict, or in any way limit, the scope of the appended claims to such detail. Additional advantages and modifications will readily appear to those skilled in the art. For example, in the described embodiment of FIG. 1, the heater 20 is connected to a DC supply; however, in one alternative embodiment using a single or polyphase AC source, two heaters may be connected drain-to-drain in a series circuit. In another embodiment, two heaters may be connected in a parallel circuit in which diodes are used to provide isolation from an AC source. Further, FIGS. 3 and 4 illustrate exemplary embodiments of closed loop systems using the semiconductor heater 20, 20*a* respectively. Other embodiments of closed loop systems using a semiconductor heater may be implemented in accordance with the inventions claimed herein. Further, the switch S1 and switch control 32 may be implemented using many known components and control strategies that range from manually operated systems to fully automatic systems.

Therefore, the invention in its broadest aspects is not limited to the specific details shown and described. Consequently, departures may be made from the details described herein without departing from the spirit and scope of the claims which follow.

What is claimed is:

1. A self-regulating heater connectable to a power supply, the heater comprising:

a three terminal semiconductor for converting electrical energy into thermal energy, the semiconductor comprising a control terminal and adapted to be connectable to the power supply; and a biasing network electrically connected to the control terminal and operable to forward bias the semiconductor, the biasing network comprising a device with a negative temperature coefficient that is thermally coupled to the semiconductor and adapted to be electrically connectable to the power supply, the biasing network operating the semiconductor as a constant current source with its output power being linearly proportional to an applied voltage to cause the semiconductor to conduct more current at lower temperatures and less current at higher temperatures.

2. The heater of claim 1 wherein the biasing network further comprises a nonlinear element operable to cause current conduction in the semiconductor to remain substantially constant until a self-limiting temperature is reached.

3. The heater of claim 2 wherein the semiconductor has a control input and the device is electrically connected between a first power supply terminal and the control input.

4. The heater of claim 3 wherein the nonlinear element is electrically connected in parallel with the device.

5. The heater of claim 4 wherein the biasing network further comprises a resistance electrically connected between the control input and a second power supply terminal.

6. The heater of claim 5 wherein the semiconductor comprises a field effect transistor.

7. The heater of claim 5 wherein the nonlinear element comprises a zener diode.

8. The heater of claim 5 wherein the device comprises a thermistor.

9. The heater of claim 1 further comprising a switch electrically connected to the semiconductor and operable to initiate and terminate current conduction through the semiconductor.

10. The heater of claim 9 further comprising a switch control electrically connected to the switch and operable to control current conduction through the semiconductor to limit a semiconductor temperature to a desired set point value.

11. A self-regulating heater operable to heat a thermal load and connectable to a power supply, the heater comprising:

a three terminal semiconductor for converting electrical energy into thermal energy, the semiconductor comprising a control terminal and adapted to be thermally coupled to the load and electrically connectable to the power supply;

a biasing network electrically connected to the control terminal and operable to forward bias the semiconductor, the biasing network comprising a device with a negative temperature coefficient, the device being thermally coupled to the semiconductor and adapted to be electrically connectable to the power supply, the biasing network operating the semiconductor as a constant current source with its output power being linearly proportional to an applied voltage to cause the semiconductor to conduct more current at lower temperatures and less current at higher temperatures;

a switch electrically connected to the semiconductor; and a switch control electrically connected to the switch, the switch control being operable to cause a temperature of the load to rise to a desired temperature.

12. A self-regulating heater operable to heat a thermal load and connectable to a power supply, the heater comprising:

a three terminal semiconductor for converting electrical energy into thermal energy, the semiconductor adapted to be thermally coupled to the load and connectable to the power supply and the semiconductor comprising a gate for controlling current conduction through the semiconductor;

a nonlinear element connected between the power supply and the gate, the nonlinear element causing current conduction in the semiconductor to remain substantially constant until a self-limiting temperature is reached; and a device having a negative temperature coefficient electrically connected in parallel with the nonlinear element and thermally coupled to the semiconductor, the device, the semiconductor and the nonlinear element being operable such that the semiconductor operates as a constant current source with its output power being linearly proportional to an applied voltage and at temperatures below the self-limiting temperature, the device conducts less current and the semiconductor conducts more current, thereby conducting more thermal energy into the load, and at temperatures above the self-limiting temperature, the device conducts more current and the semiconductor conducts less current, thereby conducting less thermal energy into the load.

13. The heater of claim 12 further comprising a control line by which the heater may be activated or deactivated.

14. The heater of claim 13 further comprising a switching device connected to the control line and operable to control current conduction in the semiconductor to maintain the load at a desired temperature.

15. A method of operating a self-regulating heater to heat a thermal load, the method comprising:

initiating current conduction through a three terminal semiconductor to convert electrical energy to thermal energy, the semiconductor being thermally coupled to the load, thereby transferring the thermal energy to the load, and the semiconductor being thermally coupled to a device with a negative temperature coefficient and the device being electrically connected to a control input of the semiconductor; and controlling current conduction through the semiconductor using the device with a negative temperature coefficient to operate the semiconductor as a constant current source with its output power being linearly proportional to an applied voltage and causing the semiconductor to conduct more current at lower temperatures and less current at higher temperatures.

16. The method of claim 15 further comprising causing current conduction in the semiconductor to remain substantially constant until a self-limiting temperature is reached by using a nonlinear element connected in parallel with the device.

17. The method of claim 16 further comprising reducing current conduction through the semiconductor using the device with a negative temperature coefficient to provide a semiconductor temperature about equal to the self-limiting temperature.

18. The method of claim 17 further comprising producing a temperature in the semiconductor less than the self-limiting temperature by controlling conduction through the semiconductor with a switching device in accordance with a temperature control strategy.

* * * * *